US007147498B1

(12) United States Patent
Gillespie et al.

(10) Patent No.: US 7,147,498 B1
(45) Date of Patent: Dec. 12, 2006

(54) CONNECTOR FOR FLEXIBLE PRINTED CIRCUIT

(75) Inventors: Brian J. Gillespie, Harrisburg, PA (US); Kevin E. Walker, Hershey, PA (US); Richard Malehorn, II, York, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/246,963

(22) Filed: Oct. 7, 2005

(51) Int. Cl.
*H01R 13/62* (2006.01)

(52) U.S. Cl. ..... 439/260

(58) Field of Classification Search ..... 439/267, 439/495, 260, 261
See application file for complete search history.

(56) References Cited

U.S. PATENT DOCUMENTS 5,842,883 A * 12/1998 Igarashi et al. ..... 439/495
6,099,346 A 8/2000 Hashiguchi et al.
6,755,682 B1 6/2004 Kunishi et al.
2004/0023551 A1* 2/2004 Suzuki et al. ..... 439/495
2005/0208824 A1* 9/2005 Kayama et al. ..... 439/495

* cited by examiner

*Primary Examiner*—Phuong Dinh
(74) *Attorney, Agent, or Firm*—Wei Te Chung

(57) ABSTRACT

A connector for a sheet-like member includes a housing (1) providing an open mouth (110) for receiving the sheet-like member and a support surface (122); terminals (2, 3) arranged in the housing and each comprising a fulcrum portion (25, 35), a contact beam (22, 32) extending into the open mouth from the fulcrum portion and a pivot beam (24, 34) extending in opposite direction to the contact beam from the fulcrum portion; and an actuator (4) rotatable between an open and a closed positions. The actuator has shaft portions (41) pivotally engaging with the pivot beams and cam portions (42) between the shaft portions and rotatably supported on the support surface. The shaft portions will urge upwards the pivot beams to force the contact beams against the sheet-like member with aid of the fulcrum portions while the actuator is rotated from the open position to the closed position.

15 Claims, 7 Drawing Sheets

CONNECTOR FOR FLEXIBLE PRINTED CIRCUIT

BACKGROUND OF THE INVENTION

1. Field of the Invention

The present invention relates to an electrical connector, and more particularly to an electrical connector for a sheet-like connection member such as a flexible printed circuit or cable (FPC), a flexible flat cable (FFC) and so forth. All of these cables and circuit hereafter will be generally referred to as "FPC" for simplification.

2. Description of Related Art

FPC connectors are roughly classified into two kinds. Typical FPC connectors of the first kind are disclosed in U.S. Pat. Nos. 6,099,346 and 6,755,682, and they generally have a plurality of terminals, and a housing fixing the terminals. Each of the terminals is substantially in the form of a U-shape and mainly composed of a contact beam adapted to contact an FPC, and a pivot beam opposed to and extending substantially parallel to the contact beam. Those U-shaped terminals are side-by-side arranged in the housing and define an open mouth together with the housing between the contact beams and pivot beams thereof for receiving the FPC. The connectors further have an actuator adapted to urge the FPC to connect with the terminals. The actuator is provided with shaft portions each pivotably supported at a free end of the pivot beam and cam portions disposed between the free ends of every two pivot beams. Thus the actuator is rotatable between an open position and a closed position via pivotal engagement of the shaft portions and the pivot beams. When the actuator is at the open position the FPC can be inserted into said open mouth with "zero-insertion force". When the actuator is rotated to the closed position, the cam portions pressed on the FPC and urged the FPC to connect with the contact beams of the terminals. However, the connection relationship of this kind of FPC connector is not reliable enough because that any unmeant drag or pull incautiously put on the FPC may cause the cam portions to reverse so as to loose the FPC, and therefore the FPC is apt to be dragged out of the open mouth.

There is another kind of FPC connector could well solve the above-mentioned problem. US. Pat. No. 2004/0023551 discloses a typical connector of this kind. The connector comprises terminals each substantially in form of an H-shape. The H-shaped terminal comprises four beams and a fulcrum portion joining the four beams, wherein two opposed beams, both serve as contact beams adapted to contact an FPC, and designated as an upper contact beam and a lower contact beam respectively, and the other two opposed beams respectively serves as a connection beam adapted to be connected to a board and a pressure receiving beam. The terminals are arranged in a housing in a fashion that the two opposed contact beams thereof extend forwards to define an FPC receiving mouth therebetween, and the connection and pressure receiving beams thereof extend rearwards to engage with an actuator. The actuator is provided with oval-shaped shaft portions, functioning as cam portions as well, pivotally moved between the connection and pressure receiving beams of the terminals to urging the two opposed contact beams to clamp the FPC, thereby achieving reliable connection of the connector. The pressure receiving beam is provided with a projection at the tip end thereof for preventing the oval-shaped shaft portion from getting out of the space between the connection and pressure receiving beams.

However, as the shaft portions of the actuator are of oval-shapes, rather than round shapes, they would have a lot of wear during their pivotal movement between the sharp shear edges of the connection and pressure receiving beams of the terminals, especially since the shaft portions are made from resin material whereas the connection and pressure receiving beams of the terminals are made from metal material. The high wear of the shaft portions may disable the actuation function of the actuator and thus can't be ignored. Further, the shaft portion of oval-shape would be angled to wedge up the pressure receiving beam and then escaping out of the space between the connection and pressure receiving beams during initial stroke, or it may become wedged between the connections beam and the projection of the pressure receiving beam, causing binding and/or damage of the actuator. Furthermore, as the terminal must be shaped to provide a relatively large clearance between the connection and pressure receiving beams for the major axis of the oval shaft portion, it cause strength concerns for the design of the pressure receiving beam in lower profile connectors.

Therefore, a new FPC connector is desired to overcome the disadvantages of the prior arts.

SUMMARY OF THE INVENTION

An object of the present invention is to provide an FPC connector in which an FPC can be reliably connected.

Another object of the present invention is to provide an FPC connector in which an actuator is avoided from high wear and therefore provides a reliable actuation.

In order to achieve above-mentioned objects, an FPC connector for connecting an FPC in accordance with a preferred embodiment of the present invention includes a housing providing an open mouth for being inserted with the FPC at a front section thereof and a support surface at a rear section thereof; a plurality of terminals side-by-side arranged in the housing, and each comprising a fulcrum portion, a contact beam extending into the open mouth from the fulcrum portion and a pivot beam extending substantially in opposite direction to the contact beam from the fulcrum portion; and an actuator rotatable between an open position and a closed position, the actuator provided with shaft portions pivotally engaging with the pivot beams, and cam portions between the shaft portions and rotatably supported on the support surface of the housing. The shaft portions and the cam portions are dimensioned so that the shaft portions can urge upwards the pivot beams to force the contact beams against the FPC with aid of the fulcrum portions while the actuator is rotated from the open position to the closed position.

Other objects, advantages and novel features of the present invention will become more apparent from the following detailed description of the present embodiment when taken in conjunction with the accompanying drawings.

DETAILED DESCRIPTION OF THE INVENTION

Figure 1A:
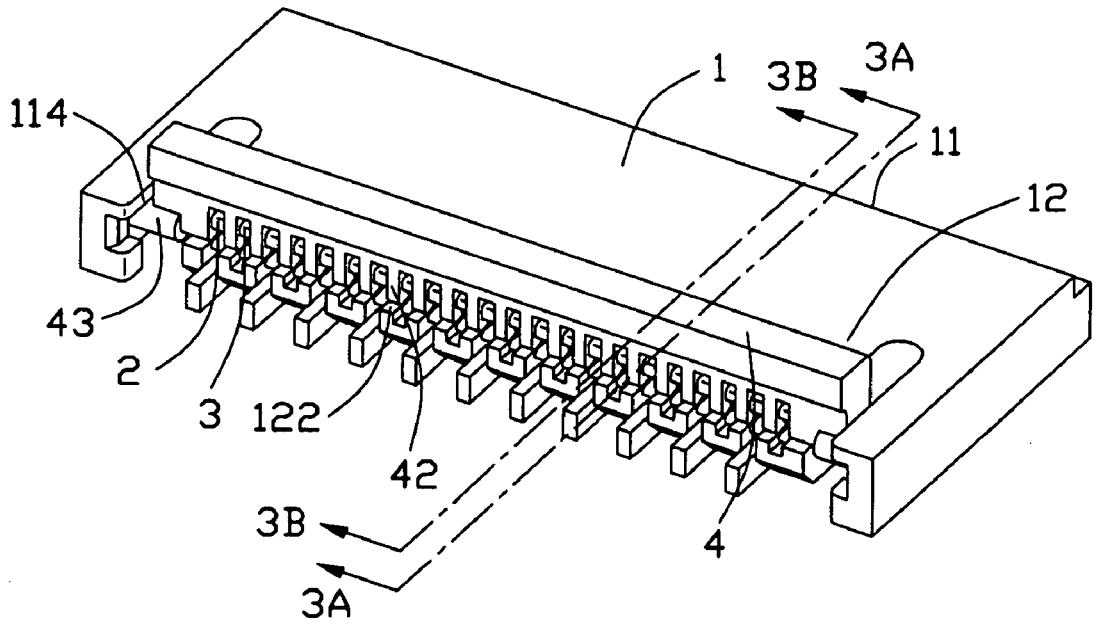
FIG. 1A is an assembled perspective view of an FPC connector in accordance with the preferred embodiment of the present invention, viewed from a rear of the housing.

Reference will now be made to the drawing figures to describe the preferred embodiment of the present invention in detail.

Referring to FIGS. 1–5, an FPC connector for connecting an FPC 5 (shown in FIGS. 4A and 4B) to a board or the like in accordance with a preferred embodiment of the present invention comprises a plurality of terminals, including two types of terminals, first terminals 2 and second terminals 3, an actuator 4 which is pivotally moved to urge the terminals 2, 3 to connect with the FPC 5, and an insulative housing 1 holding the terminals 2, 3. The housing 1 comprises a front section 11 providing an open mouth 110 for receiving the FPC 5 and a rear section 12 providing a space for operation of the actuator 4.

Figure 3A:
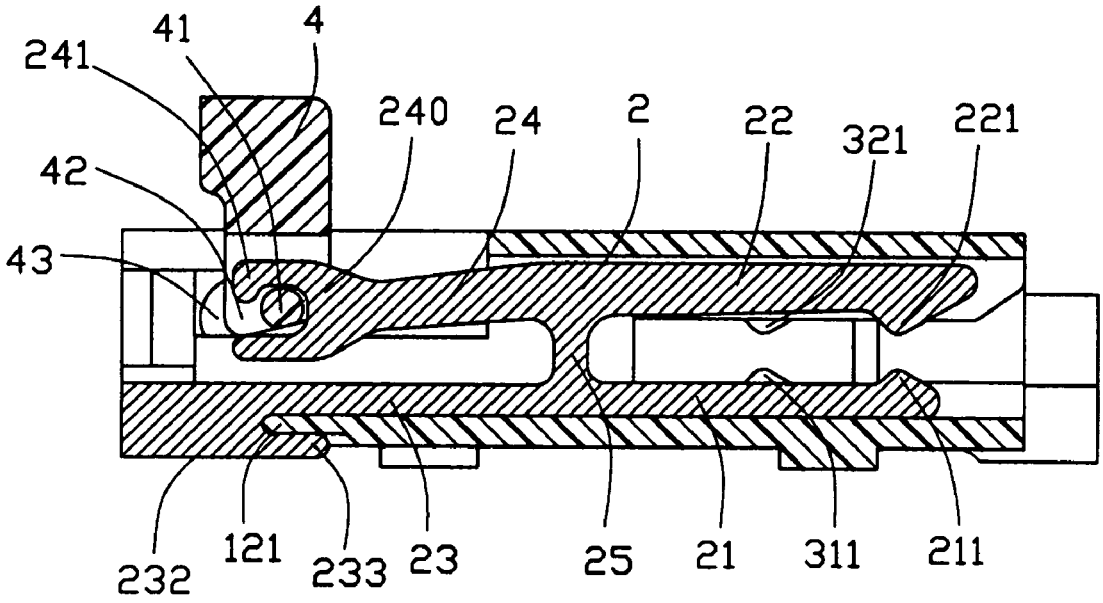
FIG. 3A is a cross-sectional view of FIG. 1 taken along line 3A—3A showing a first terminal of the connector, and wherein an actuator is placed at an open position.
Figure 3B:
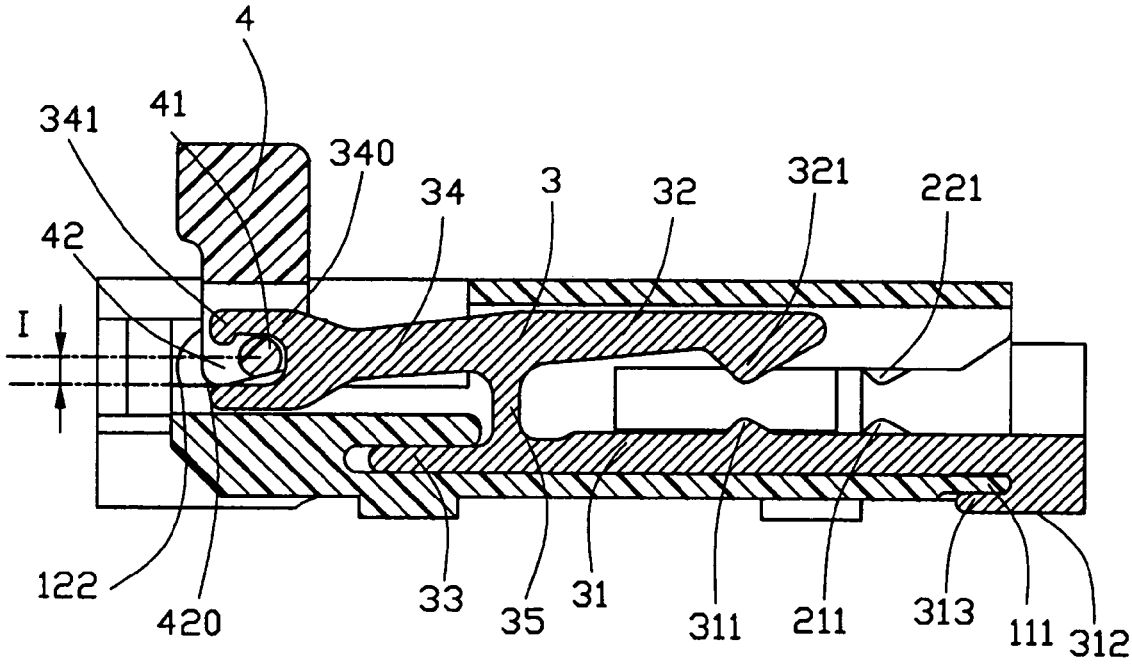
FIG. 3B is a cross-sectional view of FIG. 1 taken along line 3B—3B showing a second terminal of the connector, and wherein an actuator is placed at an open position.

First, the terminals 2, 3 will be explained. The first terminals 2 and second terminals 3 are alternately arranged in the housing 1 in a side-by-side fashion. As best shown in FIGS. 3A and 3B, both the first terminal 2 and second terminal 3 are H-shaped and mainly composed of a fulcrum portion and four beams horizontally extending from the fulcrum portion.

The first terminals 2 are forwardly inserted into the housing 1 from the rear side (left side in FIG. 3A) of the housing 1 and have two opposed beams 21 and 22 thereof extend forwards into the open mouth 110 for contacting the FPC 5 and the other two opposed beams 23 and 24 remained in the rear section 12 of the housing 1, and a retention hook 233 provided at the beam 23 clip the rear edge 121 of the bottom wall of the housing 1. The beams 21 and 22 are respectively designated as lower and upper contact beam, and each has a contact point at free ends thereof. The two contact points oppose to each other to embrace the PFC 5 inserted therebetween. The beam 23 extending from the fulcrum portion 25 in the opposite direction to the lower contact beam 21 mainly serves as a solder beam provided with a solder surface 232 adapted to be soldered onto the board, and is further provided with a retention function for retaining the first terminal 2 to the housing 1 due to the retaining hook 233 clipping the rear edge 121 of the housing 1. The beam 24 extending from the fulcrum portion 25 in the opposite direction to the upper contact beam 22 serves as a pivot beam provided with a yoke 240 at the end thereof for the actuator 4.

Differently, the second terminals 3 are rearwards inserted into the housing 1 from the front side (right side in FIG. 5) of the housing 1 and have two opposed beams 33 and 34 thereof extended rearwards to the rear section 12 of the housing 1 and the other two opposed beams 31 and 32 remained in the open mouth 110 for contacting the PFC, and a retention hook 313 clip the front edge 111 of the bottom wall of the housing 1. The beams 31 and 32 are also respectively designated as the lower and upper contact beam each provided with a contact point. The lower contact beam 31 further is provided with a solder surface adapted to be soldered onto the board. The beam 33 is fixed in a slot defined in the bottom wall of the rear section 12 so as to further retain the second terminal 3 to the housing 1. The beam 34 extending from the fulcrum portion 35 in the opposite direction to the upper contact beam 32 serves as a pivot beam provided with a yoke 340 for the actuator 3 as well as the pivot beam 24 of the first terminal 2.

In assembly, the contact points 211, 221 of all the first terminals 2 are aligned with each other along a first longitudinal direction of the housing 1 and arranged in a first contact point line, while the contact points 311, 321 of all the second terminals 3 are aligned with each other along a second longitudinal direction of the housing 1 and arranged in a second contact point line. The first contact point line is located in front of the second contact point line in this preferred embodiment. With such a design, the two types of the terminals, the first terminals 2 and second terminals 3, contact the PFC 5 in different location. Certainly, in some instances, all those contact points 211, 221, 311, 321 could be aligned with each other and arranged in a single line as well.

Figure 1B:
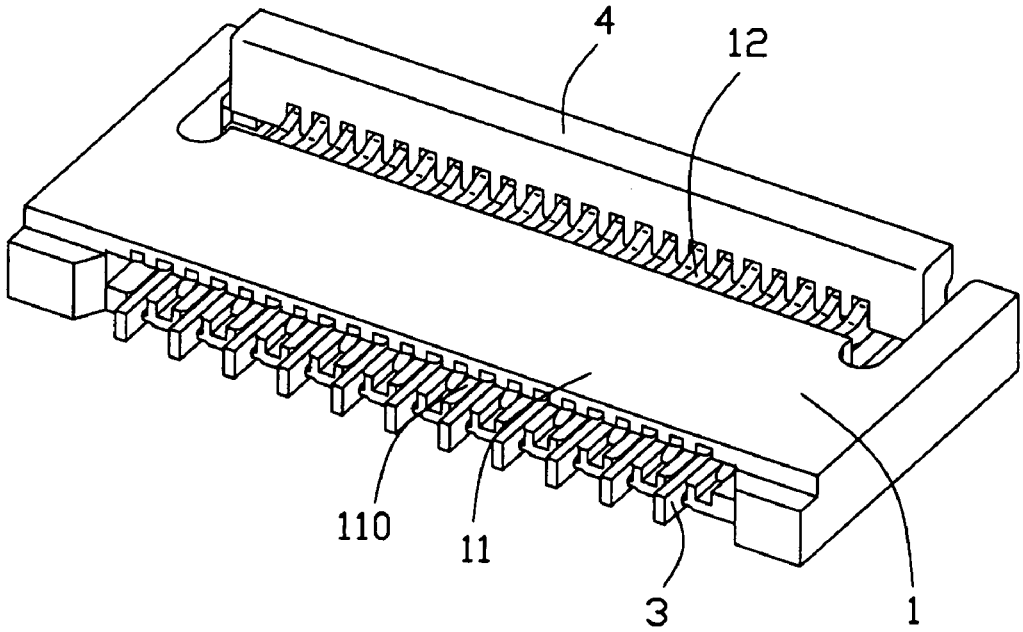
FIG. 1B is an assembled perspective view of an FPC connector in accordance with the preferred embodiment of the present invention, viewed from a front of the housing.
Figure 2:
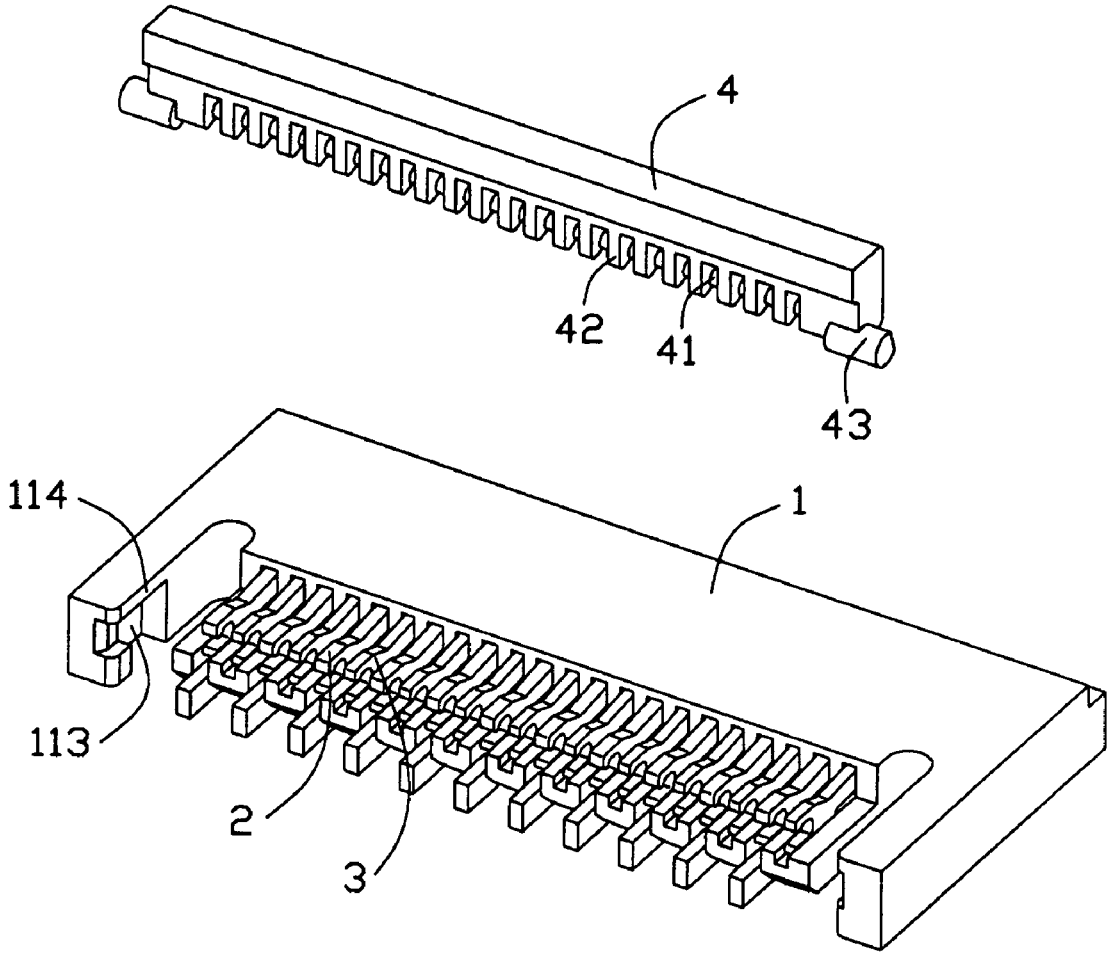
FIG. 2 is an exploded perspective view of the FPC connector shown in FIG. 1A.
Figure 4A:
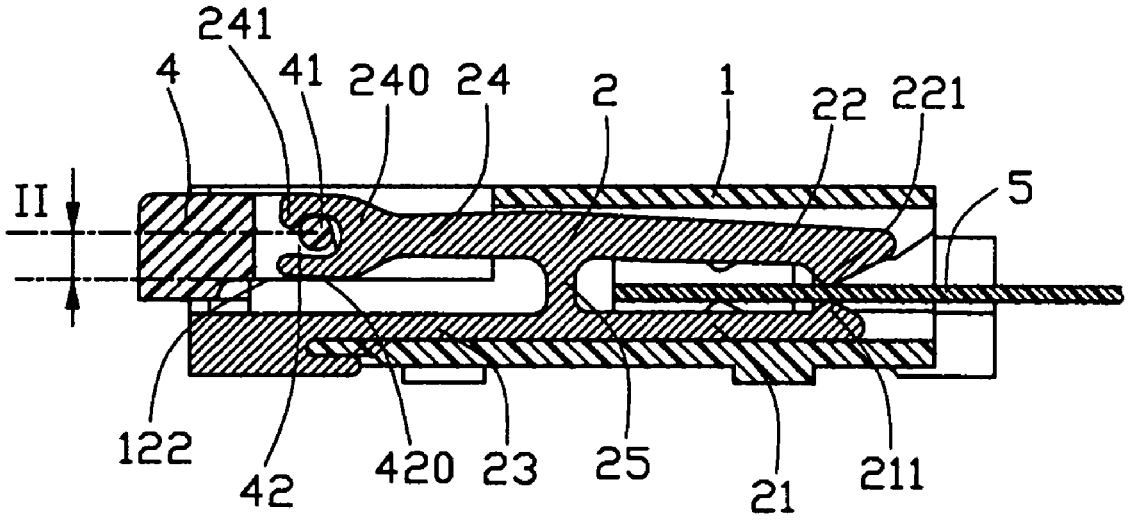
FIG. 4A is a cross-sectional view similar to FIG. 3A, but wherein the connector has been inserted with an FPC and the actuator has been rotated to a closed position.
Figure 4B:
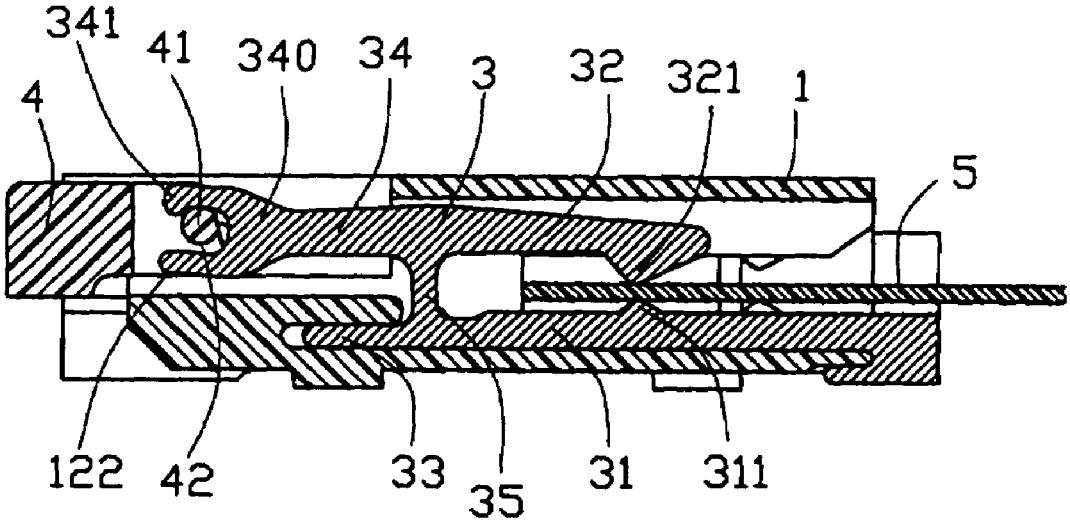
FIG. 4B is a cross-sectional view similar to FIG. 3B, but wherein the connector has been inserted with an FPC and the actuator has been rotated to a closed position.
Figure 5:
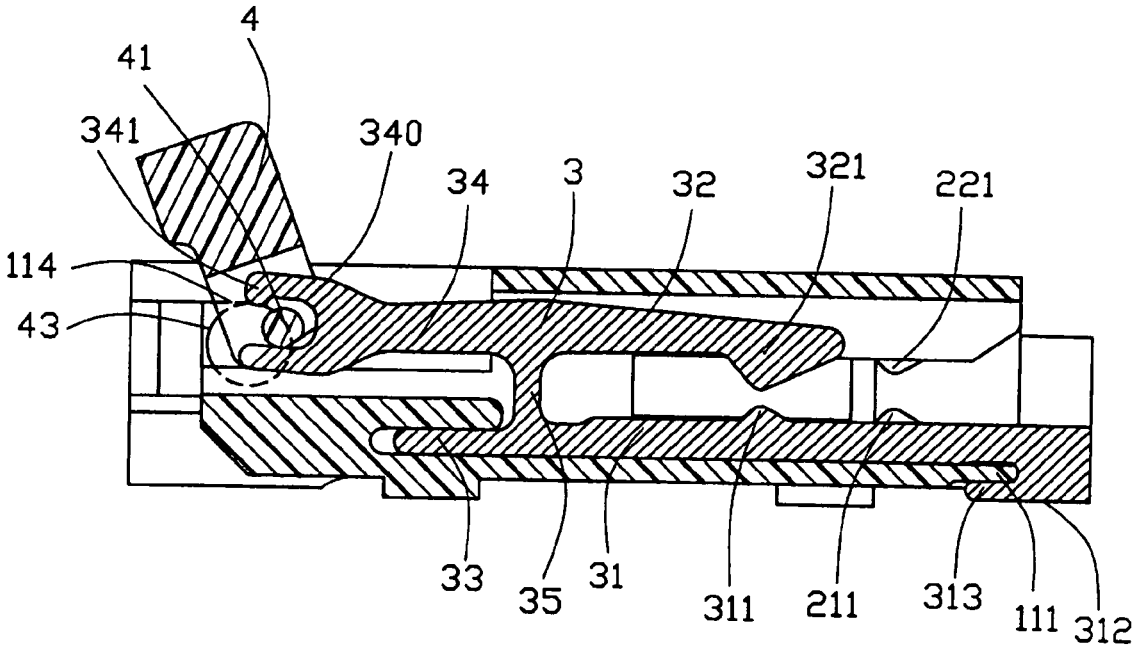
FIG. 5 is a cross-sectional view showing the actuator being returned from the closed position to the open position.

As best shown in FIG. 3, the actuator 4 is formed into an elongated plate. In order to engage with the yokes 240, 340 of the pivot beams 24, 34 of the terminals 2, 3, sectionally circular shaft portions 41 are provided on one side edge of the actuator 4 at a position respectively corresponding to the position of the yoke ends. Between adjacent shaft portions 41 are cam portions 42. As shown in FIG. 1, in assembly, the shaft portions 41 are respectively and pivotably received in the yokes 240, 340, and the cam portions 42 are located between adjacent pivot beams 24, 34 of the terminals 2, 3, and the actuator 4 is therefore rotatable between a open position (as shown in FIG. 3A or 3B) and a closed position (as shown in FIG. 4A or 4B). As sections of the shaft portions 41 are circular other than oval, the shaft portions 41 would not become wedged in the yoke 240 (or 340) to cause binding and therefore perform good pivotal movement in the yokes 240, 340 during rotation of the actuator 4.

Referring to FIGS. 3A–4B, now the manner of connection of the PFC 5 will be discussed. At the beginning, the actuator 4 is located in the open position, the actuator 4 is supported by the housing with the cam portions 42 thereof rested on a support surface 122 of the bottom wall of the housing 1, and the contact beams 22 (or 32) are at their original relaxed status, therefore the PFC 5 can be easily inserted in the open mouth 110, exactly, between opposed contact beams 21, 22 (or 31, 32). As best shown in FIG. 1A, the support surface 122 is the incontinuous upper surface of the bottom wall of the housing 1 between every two adjacent terminals 2 or 3. After the PFC 5 is inserted between the opposed contact beams 21, 22 (or 31, 32), the actuator 3 is rotated to the closed position. During this rotation, the cam portion 42 has its convex exterior surface 420 serve as engaging surface for engaging with the support surface 122 of the housing 1. As the dimension I (designated in FIG. 3B) between axis center of the shaft portion 42 and a first point of the convex exterior surface 420 of the cam portion 42 that is rested on the support surface 122 while the actuator 4 at the open position is smaller than the dimension II (designated in FIG. 4A) between axis center of the shaft portion 41 and a second point of the convex exterior surface 420 of the cam portion 42 that is rested on the support surface 122 while the actuator 4 at the closed position, the shaft portion 41 is lifted after the actuator 4 is rotated from the open position to the closed position. Therefore the yoke 240 (or 340) will be urged upwards by the lifted shaft portion 41, as a result of which the pivot beam 24 (or 34) is tilted to force the upper contact beams 21 (or 31) against the PFC 5 with aid of the fulcrum portion 25 (or 35).

In this preferred embodiment, the actuator 4 has a pair of bosses 43 respectively extending from two longitudinal ends thereof to be received in a recess 113 defined at side portion of the housing 1 and supported below a top flange 114 of the housing 1, and the yoke 240 (or 340) of the terminal 2 (or 3) is formed of a U-shape comprising an upper part and a lower part wherein the upper part is formed with a projection 241 (or 341) at the tip end thereof for preventing the shaft portion 41 from escaping from the yoke 240 (or 340). Both the boss 41 and the lower part of the yoke 240 (or 340) have a function helping to return the terminals 2 (or 3), which will be described in detail hereafter.

As sometimes it is required to disconnect the terminals 2, 3 and the PFC 5, so that the upper contact beams 22, 32 are required to return to their original relaxed status to release the PFC 5. For that, the actuator 4 is rotated from the closed position to the open position. During this operation, the boss 43 of the actuator 4 contacts the top flange 114 which provides a force to push down the actuator 4, making the shaft portions 41 disengage from the upper part of yoke 240 (or 340) and then press onto the lower part of the yoke 240 (or 340) to tilt up the upper contact beam 22 (or 32) to their original status with the aid of the fulcrum portion 25 (or 35). So, the lower part of the yoke 240 provides a good terminal-returning function that enhances the returnability of the terminal 2 (or 3) from an engagement status to an original relaxed status. However, the lower part of the yoke 240 is not a necessarily required part of the invention and it can be included on both kinds of terminals 2 and 3, one of the two kinds of terminals 2 and 3, or neither of the two kinds of terminals 2 and 3 in few instances.

According to this preferred embodiment, the operation of the actuator 4 does not bring high wear, because the mainly rubbing parts, the cam portions 42 of the actuator 4 and the support surface 122 of the housing 1, are both made from resin and thus the wear therebetween will not be serious. Moreover, providing round shaft portions 41 of circular section, other than oval ones, to be pivoted in the yokes 240, 340 largely reduces wear of the shaft portions 41 because the round shaft portions 41 do not translate horizontally during rotation of the actuator 4.

However, the disclosure is illustrative only, changes may be made in detail, especially in matter of shape, size, and arrangement of parts within the principles of the invention.

What is claimed is:

1. An electrical connector adapted to be detachably fitted with a sheet-like member, comprising:

an insulative housing providing an open mouth for being inserted with the sheet-like member at a front section thereof and a support surface at a rear section thereof;

a plurality of terminals side-by-side arranged in the housing, and each comprising a fulcrum portion, a contact beam extending into the open mouth from the fulcrum portion and a pivot beam extending substantially in opposite direction to the contact beam from the fulcrum portion; and an actuator rotatable between an open position and a closed position, said actuator provided with shaft portions pivotally engaging with the pivot beams, and cam portions between the shaft portions and rotatably supported on the support surface of the housing, wherein the shaft portions and the cam portions are dimensioned so that the shaft portions can urge upwards the pivot beams to force the contact beams against the sheet-like member with aid of the fulcrum portions while the actuator is rotated from the open position to the closed position; wherein the cam portion is formed with a convex exterior surface having a first point contacting the support surface when the actuator is at the open position and a second point contacting the support surface when the actuator is at the closed position, and a dimension between the first point and the axis center of the shaft portion is smaller than a dimension between the second point and the axis center of the shaft portion; wherein the actuator has bosses respectively extending from longitudinal ends thereof and the housing has a to flange and a recess below the top flange accommodating a corresponding boss; wherein the support surface is an incontinuous upper surface of a bottom wall of the housing between every two adjacent terminals; wherein the pivot beam is formed with a yoke at the end thereof for accommodating the shaft portion, the yoke substantially of a U-shape comprising an upper and a lower parts.

2. The electrical connector as described in claim 1, wherein the shaft portion is substantially of a circular section.

3. The electrical connector as described in claim 2, wherein the pivot beam defines a concave portion for receiving the shaft portion, the concave portion having a dimension substantially equal to a dimension of the shaft portion along a lengthwise direction of the pivot beam.

4. The electrical connector as described in claim 1, wherein the pivot beam is formed with a projection for preventing the shaft portion from disengaging the pivot beam.

5. The electrical connector as described in claim 4, wherein the shaft portion of the actuator substantially performs an upward movement when the actuator is rotated from the open position to the closed position.

6. The electrical connector as described in claim 1, wherein each of the terminals has a second contact beam extending into the open mouth from the fulcrum portion and in opposition to said contact beam, the two contact beams embracing the sheet-like member therebetween.

7. The electrical connector as described in claim 6, wherein each of the terminals has a fourth beam extending substantially in opposite direction to the second contact beam from the fulcrum portion.

8. The electrical connector as described in claim 7, wherein the terminals include first and second terminals alternately arranged in the housing, and wherein the first terminal defines a solder surface at the fourth beam and the second terminal defines a solder surface at the second contact beam adapted to be soldered onto a board.

9. An electrical connector assembly comprising:

a flexible printed circuit (FPC);

an insulative housing defining a FPC receiving cavity in a front portion to receive said FPC;

a plurality of terminals side by side arranged in the housing, each including a yoke section defining a pivot axis space therein, and a contacting beam with a contacting region thereon engaged with a corresponding conductive pad of the FPC, said contacting region being space from said yoke section; and an actuator moveable relative to the housing in a rotation manner, said actuator including a plurality of spaced cam portions with a corresponding slot formed between every adjacent two spaced cam portions, a shaft portion formed in each slot and received in the pivot axis space of the yoke section of the corresponding terminal which is received in the corresponding slot; wherein the yoke section does not physically contact the FPC; wherein said housing further includes a support surface which the cam portions abut against when the actuator is moved to a horizontal locking position whereby the FPC is firmly engaged with the contacting regions of the contacting beams of the terminals.

10. The assembly as claimed in claim 9, wherein the support surface is located in a rear portion of the housing.

11. The assembly as claimed in claim 9, wherein the contacting region and the yoke section are respectively located at two opposite ends of the corresponding terminal in a front-to-back direction.

12. The assembly as claimed in claim 9, wherein said yoke section is located in a rear portion of the housing.

13. The assembly as claimed in claim 9, wherein two lances of the yoke section extend essentially in a horizontal manner.

14. An electrical connector for use with a flexible printed circuit (FPC), comprising:

an insulative housing defining a FPC receiving space in a front portion thereof;

a plurality of terminals side by side disposed in the housing, each of said terminals defining a pivot axis space and a contacting region opposite to said pivot axis space; and an actuator moveable relative to the housing in a rotation manner, said actuator defining a plurality of spaced cam portions and a plurality of slots alternately arranged with each other along a transverse direction of the housing, a plurality of shaft portions respectively formed in the corresponding slots, and respectively received in the corresponding pivot axis spaces; wherein said housing further defines a support surface which the cam portions abut against when the actuator is moved to a horizontal locking position whereby the FPC is firmly engaged with the contacting regions of the contacting beams of the terminals without direct engagement with the actuator; wherein the pivot axis space and the contacting region of the same terminal are respectively located at two opposite ends of the terminal in a front-to-back direction perpendicular to said transverse direction; wherein both the support surface and the pivot axis spaces are located in a rear portion of the housing; wherein said actuator is located in the rear portion of the housing; wherein said pivot axis space is formed by a yoke section.

15. The connector as claimed in claim 14, wherein two lances of said yoke section extend in a horizontal manner.

* * * * *